US006443385B1

(12) United States Patent
Grandauer et al.

(10) Patent No.: US 6,443,385 B1
(45) Date of Patent: Sep. 3, 2002

(54) METHOD AND DEVICE FOR WINDING STRAND-SHAPED WINDING MATERIAL ONTO A COIL

(75) Inventors: Michael Grandauer, Kaufering; Dieter Spriegel, München; Reiner Schneider, Ebersdorf; Günter Doemens, Holzkirchen, all of (DE)

(73) Assignee: CCS Technology, Inc., Wilmington, DE (US)

( * ) Notice: Subject to any disclaimer, the term of this patent is extended or adjusted under 35 U.S.C. 154(b) by 0 days.

(21) Appl. No.: 09/446,229

(22) PCT Filed: Jun. 16, 1998

(86) PCT No.: PCT/DE98/01630

§ 371 (c)(1),
(2), (4) Date: Dec. 17, 1999

(87) PCT Pub. No.: WO98/58865

PCT Pub. Date: Dec. 30, 1998

(30) Foreign Application Priority Data

Jun. 20, 1997 (DE) ..... 197 26 285

(51) Int. Cl.[7] ..... B65H 54/28
(52) U.S. Cl. ..... 242/476.7; 242/478.2
(58) Field of Search ..... 242/478.2, 920, 242/476.7

(56) References Cited

U.S. PATENT DOCUMENTS 4,410,147 A * 10/1983 Seibert ..... 242/478.2
4,928,904 A * 5/1990 Watts ..... 242/478.2

FOREIGN PATENT DOCUMENTS

| | | | | |
|---|---|---|---|---|
| EP | 0 043 366 | | 1/1982 | |
| EP | 0 129 926 | * | 2/1985 | ..... B65H/54/28 |
| EP | 0 362 800 | | 4/1990 | |
| WO | WO 94/13568 | | 6/1994 | |
| WO | WO 9413568 | * | 6/1994 | ..... B65H/54/28 |

OTHER PUBLICATIONS

Abstract of Japanese Patent Application 01–203174 (Aug. 15, 1989), Patent Abstracts of Japan, vol. 13, No. 506 (M–892), Nov. 14, 1989.

Abstract of Japanese Patent Application 04–016464 (Jun. 21, 1992), Patent Abstracts of Japan, vol. 016, No. 173 (M–1240), Apr. 24, 1992.

* cited by examiner

*Primary Examiner*—Donald P. Walsh
*Assistant Examiner*—Joseph Rodriguez

(57) ABSTRACT

Strand-shaped winding material is continuously supplied to a coil, whereby the position of the winding material is observed with at least one video camera, whereby the data about the wrapping obtained in this way are conducted to a computer unit that initiates a corresponding readjustment. With reference to the coil axis and as seen in radial direction, the position of the apexes of the turns is identified for at least respectively two turns of the new winding ply, and, given a deviation of these apexes from a rated value, a readjustment is implemented in the delivery of the winding material.

18 Claims, 11 Drawing Sheets h
KT22
KT23
KT24
KT15
KT16
FL1
x h
KT22*
KT23*
KT24*
KT15*
KT16*
FL1*
x4
xF
x
ΔxF n
HF1*
xF
x

METHOD AND DEVICE FOR WINDING STRAND-SHAPED WINDING MATERIAL ONTO A COIL

BACKGROUND OF THE INVENTION

The invention is directed to a method for winding strand-shaped winding material onto a coil, whereby the winding material is continuously supplied, and whereby the position of the winding material is observed and registered by at least one video camera, and the data about the winding obtained in this way are conducted to a computer unit that initiates a corresponding readjustment of the delivery of the winding material.

A method of this species is disclosed by EP-B1 0 043 366. A video camera utilized as a first measuring means for monitoring and directed approximately tangentially or radially onto the winding ply acquires the winding ply potentially illuminated by a spot light. The position of the winding edge of the most recently wound winding is thereby identified with the video camera, namely at a point lying remote from the winding-on location of the winding material by a specific rotational coil angle. Further, a second measuring means is provided for acquiring the respective traversing position of the coil and a sensor for the winding strand is provided. Those relative positions that the coil and the guide means for the strand must have achieved after the rotation of the coil by the aforementioned rotational coil angle for maintaining the winding-on angle are calculated from the measured data of these two measuring devices. A control means serves the purpose of maintaining a constant winding-on angle for laying the windings within in each winding ply.

SUMMARY OF THE INVENTION

The invention is based on the object of assuring an optimally fast and efficient correction of deviations in a simple way. In a method of the species initially cited, this object is achieved in that the position of the apexes of the turns for at least two turns of the new winding ply are determined with reference to the coil axis as viewed in a radial direction, and in that, given a deviation of these apexes from a rated or predetermined value, a readjustment in the delivery of the winding material that reduces the deviation is implemented.

A potentially occurring error in the winding procedure can thus be simply and dependably identified because the apex supplies a significantly more exact and diagnostic information than the winding edge utilized in the prior art.

An especially advantageous development of the invention is that, due to a deviation in the size of the apex of the most recent winding from the size of the apex of a preceding winding that derives in the ascent of the most recent winding, a readjustment of the delivery for the purpose of an enlargement of the lateral spacing from the penultimate turn is implemented.

Another particularly advantageous development of the invention is characterized in that the spacing of the apexes of the turns is identified for at least two turns of the new winding ply in the region of the point of incidence of the winding material as seen in a parallel direction relative to the coil axis, and that, on the basis of an increase in the spacing between the neighboring apex values deriving given the occurrence of a gap between the penultimate and the most recent turn, a readjustment of the delivery is implemented for the purpose of diminishing the lateral spacing of the most recent turn relative to the penultimate turn.

The invention is also directed to a device for winding strand-shaped winding material onto a coil, whereby the winding material is supplied via a guide means that modifies the winding position of the winding material on the coil such that an optimum uniform winding occurs upon employment of a video camera for the observation of the winding ply that supplies the data about the position of the winding it identifies to a computer unit that initiates a corresponding readjustment of the guide means, whereby this means is characterized in that a light source is provided that generates a light band at least on parts of the last winding ply, and in that the video camera serving the purpose of the observation is arranged such that it identifies the condition of the illuminated winding ply approximately in the region of the point of incidence where the winding material meets the winding ply lying therebelow.

The invention yields the possibility that the turns and—when the turns approach the flange—the drum flange can be simultaneously acquired on the basis of appropriate illumination, particularly in the form of a light band, and, thus, the momentary spacing of the current turn from the flange can be identified in fact.

The invention and its developments are explained in greater detail below with reference to drawings.

DESCRIPTION OF THE PREFERRED EMBODIMENTS

Figure 1:
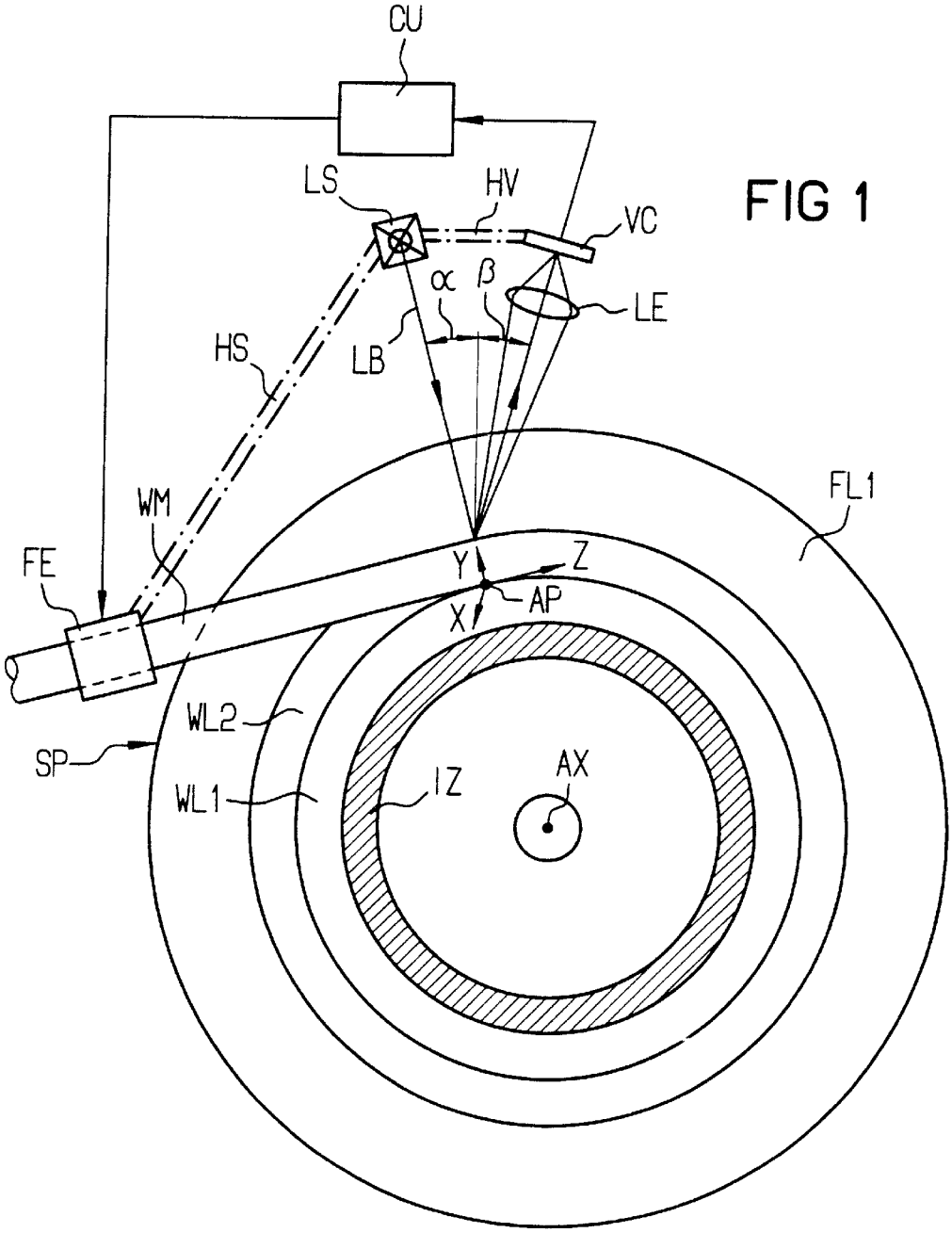
FIG. 1 is a schematic illustration of a means for the implementation of the inventive method.

Transversely relative to a winding shaft AX, FIG. 1 shows a coil or drum SP in section whose inside cylinder is referenced IZ. A winding material WM is wound onto this coil SP in one or—preferably—a plurality of plies, whereby it is desirable that this winding material is applied as tightly and uniformly as possible, i.e. that gaps do not arise between neighboring plies and that, for instance, the winding material does not rise up, i.e. is not wound onto a ply that has not yet been completed. The winding material can comprise a thread, strand, tube or some other configuration and preferably has a circular cross section. It is assumed below that a cable (electrical or optical) is applied as winding material WM. It is also assumed here that a complete winding ply (first winding ply) WL1 has already been applied on the drum SP here, whereas the second ply WL2 is being continually wound at the time with the cable WM as the winding material. The cable WM meets the first winding ply WL1 lying therebelow in a point AP that approximately corresponds to the tangent at the lower ply WL1 of the cable WM. At this point (point of incidence), thus, the winding material supplied via a guide means FE enters into contact for the first time with the winding WL1 that is already present and lies therebelow or, given a first ply, comes into contact with the inside cylinder IZ.

The coil (for example, cable drum) SP, which is often composed of wood, generally comprises two lateral flanges, whereof only the back flange, namely FL1, is visible in the present example. A light source LS is provided above the point of incidence AP and this source advantageously directs a divergent light band LB onto the cable WM. The light band LB should be selected broader than the diameter or, respectively, the width of the winding material WM, and amount to at least twice the width of the winding material, but, preferably, be at least four times this width. A laser is preferably employed as the light source LS because the light can be very sharply and exactly focused in this way.

Particularly given relatively narrow reels, it is also possible to undertake the illumination in the region of the points of incidents AP such that both the left-hand as well as the right-hand flange are always illuminated and, of course, all turns lying therebetween are also covered. This means that the width of the light band is selected somewhat greater than the coil width. In this case, it is not necessary to continuously displace the light band LB along the shaft AX together with the point of incidents AP of the winding material WM. A stationary arrangement of the light source LS then suffices, and this will always illuminate the entire width, including the flanges of the coil SP with its broad beam. When a stationary light source LS is employed, then this is expediently positioned roughly in the middle of the coil SP, i.e. the distance to the left and to the right flange of the coil is selected of approximately the same size.

When the illumination only covers some of the turns in the region of the point of incidents AP, then a continuous follow-up of the light source LS is to be undertaken, expediently in that this light source LS is mechanically coupled to the guide means FE, as indicated, for example, by the dot-dash rod HS.

In this way, an automatic follow-up and the dependable alignment of the light source LS onto the region of the point of incidents AP are assured without great outlay. This motion process ensues essentially parallel to the drum axis AX proceeding perpendicular to the plane of the drawing, so that the distance between the light source LS and the point of incidents AP is kept essentially constant.

Over and above this, given illumination of a sub-region around the point of incidents AP, the guide means FE, the light source LS coupled to it and the video camera can be implemented stationary, as usually realized in practice, when the traversing motion of the drum is produced by the wind-on means itself. Only the described disturbances in the course of the winding then have to be eliminated by correspondingly fast correction movements of the guide means.

When a plurality of winding plies are applied, then the distance between the point of incidents AP and the light source LS is somewhat reduced. Given an adequately great distance of the light source LS from the point of incidents AP, preferably at least between 1 m and 2 m, however, this is generally of no significance. Given increasing diameter of the cable winding, i.e. due to the increasing plurality of plies during the winding, the light source LS can also be potentially shifted continuously or in steps opposite the beam direction of the light beam LB toward the outside such in conformity with the increase in winding plies that the width of the light spot or, respectively, light band and the position thereof in the camera's field of view are kept essentially constant. The light source LS, in any case, should be arranged beyond the outermost edge of the respective flange (for example, FL1) in order to also enable a coverage of the flange.

It is also possible to provide more than one light source, for example two such light sources, whereof the one illuminates approximately half the winding (=half the coil width) and the one flange in addition, whereas the other light source covers the other half of the winding ply and the flange that lies opposite. The two light sources can also be implemented such that their light bands are of identical length and are congruently projected onto a region around the point of incidents AP of the cable. This arrangement is particularly advantageously utilized given the employment of a stationary guide means. When switching the video cameras dependent on the direction of the traversing drum, the point of incidents AP of the cable remains at the same image position.

It should be pointed out with respect to dependable flange recognition that the flange surfaces, particularly of wooden drums, often do not proceed plane-parallel to the rotational axis. Light source and video camera in the present case are therefore preferably expediently inclined at an angle of 5° deviating from the orthogonal onto the flange surface. As a result thereof, a potential occlusion of the light band at the flange can be prevented. When sighted onto the drum, the left-hand flange side is illuminated with the right-hand light source or, respectively, the right-hand flange side is illuminated with the left-hand light source. Three or more light sources are also conceivable, particularly when it is a matter of extremely broad coils. These several light sources are expediently rigidly positioned.

A spatial coordinate system is shown in the winding-on point AP, whereby the z-direction corresponds to the tangent at the ply WL1 lying therebelow, i.e. proceeds in circumferential direction. The y-direction points outward in a radial direction with reference to the rotational axis AX, whereas the x-direction extends parallel to the rotational axis AX. The width of the light band LB in the z-direction should be kept optimally small in order to assure an optimum optical imaging. Light band widths in the z-direction, i.e. given incidence of the light band LB onto the upper contour of the winding material WM, are preferably provided between 0.5 mm and 5 mm, particularly between 1 mm and 3 mm.

Since the light band should be as narrow as possible in the z-direction, the angle $\alpha$ between the beam axis of the light band LB and the radial direction y should preferably not be selected so large. For other reasons, too, values for angle $\alpha$ between 10 and 60° are expedient, and values between 30 and 40°, particularly around 35°, are especially advantageous.

In practice, it is expedient to align the beam direction of the light source LS such that this proceeds essentially approximately in the radial direction, i.e. is directed onto the shaft AX of the drum. As a result thereof, the point of incidence lies essentially on a continuous line given increasing winding diameter, i.e. given an increasing number of turns that have been applied. What is thereby also achieved is that it is always the points of incidents AP that is essentially illuminated and observed. This point of incidence AP generally lies somewhat farther left than in the illustration of FIG. 1 because the supplied winding material WM does not enter tangentially or horizontally but is more likely to be supplied essentially obliquely from below.

As a result of the light band extending in the x-direction and extremely narrow in the z-direction, arcuate light spots lighting up on the surface of the winding material WM are generated and these can be sensed with a video camera VC. The optics of the video camera VC—indicated by a lens LE—is aligned such that it can cover the aforementioned, arcuate, bright lines that the light band LB yields on the surface of the winding material WM. Considerations that are similar to those indicated above for the light source LS apply to the spatial arrangement of the video camera VC, i.e. the video camera can be stationarily arranged and, in this case, must be capable of covering the entire width of the winding material from one flange to the other. It is also possible to arrange a plurality of video camera stationarily next to one another, each thereof covering only a corresponding sub-region within a winding ply. Finally, it is also possible to provide a video camera covering only a sub-region, this being mechanically displaced just like the guide means FE. This is indicated by the rigid retaining arm HV proceeding from the light source LS which undertakes the continuous, mechanical displacement of the video camera VC in the same way as the aforementioned retaining arm HS from the light source LS. Further, the video camera can also be implemented stationarily together with the light source when the drum itself traverses.

With reference to the radial direction y, the beam axis of the video camera VC should expediently proceed in an angular range $\beta$ between 0° and 60°, whereby an angle of 0° is preferably employed due to the better optical conditions. On a case-by-case basic, values between 30° and 40° can also be employed, preferably particularly 35°. In general, it is expedient when the angles $\alpha$ and $\beta$ are not selected of the same size because the interpretation then becomes more optically beneficial. It is expedient when the aggregate angle $(\alpha+\beta)$ is selected such that values of about 10 through 60°, particularly about 35°, are preferably obtained.

Video camera that have an extremely high resolution, particularly what are referred to as CCD cameras are preferably employed. The light information supplied by the video camera VC are forwarded from the video camera VC to a computer unit CU wherein the evaluation is continuously implemented and proceeding from which corresponding control signals are forwarded to the guide or laying means FE in order to achieve the optimum guidance of the winding material WM in the sense of a control circuit.

Figure 2:
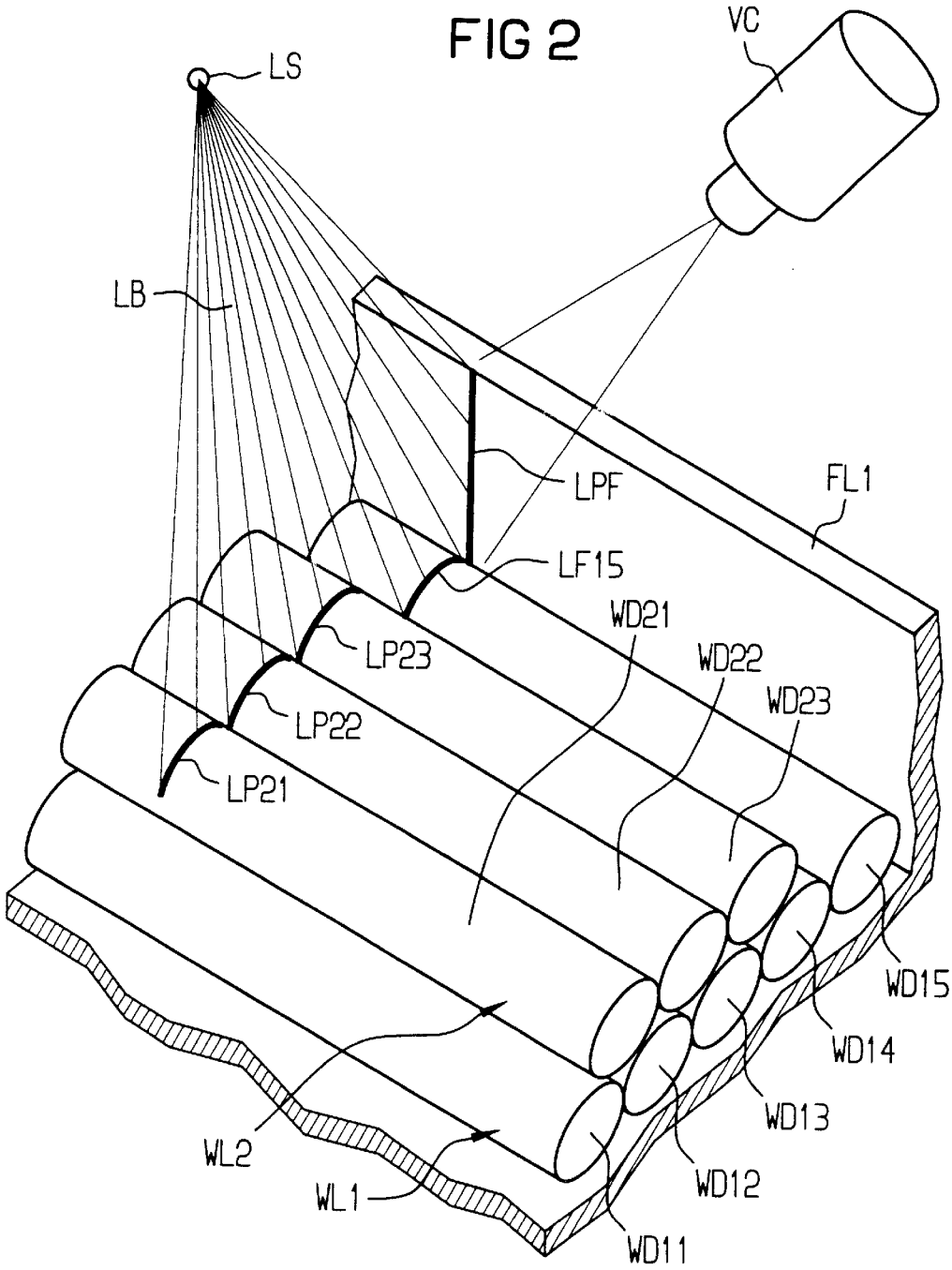
FIG. 2 shows a part of the means of FIG. 1 in a perspective view.

FIG. 2 is referenced for illustrating the relationships, this showing the relationships in the region of the winding-on point AP enlarged in a perspective view. Due to the schematically indicated light band LB of the light source LS, which has only a slight expanse in the z-direction of the winding material, arcuate height profile lines, which are referenced LP21, LP22 and LP23, arise on the turns WD21 through WD23 of the upper ply WL2. The winding ply WL1 lying therebelow and having the turns WD11 through WD15 likewise yields two bright height profile lines, only the outermost being partially visible and being referenced LP15 as a consequence of the perspective view. Further, the light band LB yields a line LPF that proceeds essentially straight in the region of the flange FL1. The position and the course of these height profile lines can be evaluated in the computer unit CU of FIG. 1 and can be utilized in a simple way for an exact acquisition of the winding condition and for generating a corresponding controlled quantity. Although shown dark in the drawing, the arcuate height profile lines LP21 through LP23, LP15 and LPF shown in FIG. 2 are bright light reflex spots in reality, i.e. zones of high light intensity.

Figure 3:
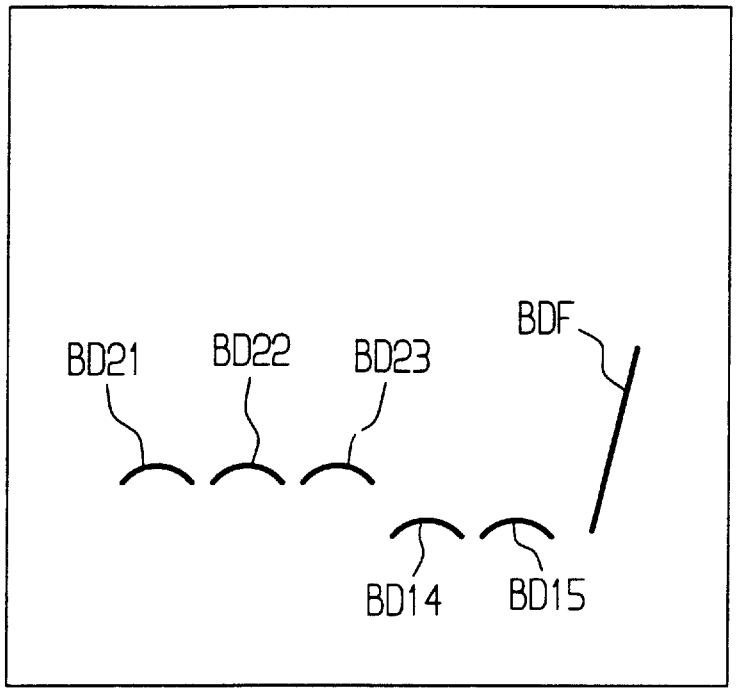
FIG. 3 shows the brightness distribution that is obtained with a means according to FIGS. 1 and 2 for a specific cable distribution.

FIG. 3 shows the appertaining gray scale image, namely for the xy-plane of FIG. 1, that is obtained in the evaluation of the line-shaped scanning of the video camera VC. The line-shaped scanning of the video camera itself expediently ensues in the x-direction, and the image signals BD21, BD22 and BD23 of FIG. 3 are obtained from the bright height profile lines LP21, LP22 and LP23 of the uppermost ply WL2 for the example according to FIG. 2. The image signals BD14 and BD15 of the height profile lines LP14 and LP15 of the turns WD14 and WD15 of the ply WL1 lying therebelow may be seen lying therebelow. Over and above this, the bright line BDF is acquired, this corresponding to the course of the flange at this location and being based on the bright light band LPF according to FIG. 2.

Figure 4:
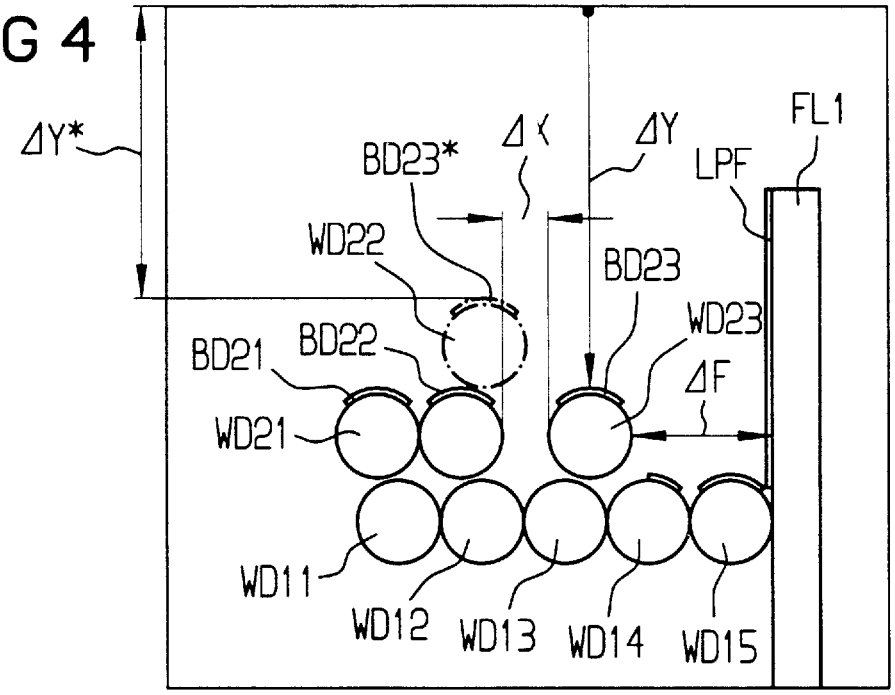
FIG. 4 shows the presentation of disturbances or irregularities within the cable plies.

In the same type of presentation as FIG. 2 and FIG. 3, FIG. 4 shows the possibilities of errors when winding up. It is thereby assumed that the turn WD23 proceeds at an inadmissibly great distance from the neighboring turn WD22, i.e. a gap, which is referenced $\Delta x$, is present between the two turns. The winding ply is thus no longer closed tightly enough and a controlled quantity must be generated that in turn eliminates this gap as quickly as possible. As may be seen, the value of $\Delta y$ for the outer height profile lines indicated by thick black strokes and the light or image arcs BD21 through BD23 resulting therefrom are respectively of approximately the same size (i.e. within the scope of the standard diameter fluctuations, etc.), i.e. no rise-up occurs here.

If, by contrast, the winding were undertaken too tight and if a rise-up had occurred, then the last turn WD23 would assume the position WD23* indicated with broken lines, and the appertaining arc would correspondingly assume the course BD23* in conformity with the height profile line. The appertaining height value $\Delta y^*$ would clearly deviate from the value $\Delta y$ for the turns WD22 and WD23 and, thus, would provide an error indication to the affect that an ascent had occurred or, respectively, is just occurring. On the basis of a fast control procedure and, for example, a corresponding intervention on the guide means FE of FIG. 1, the winding material WD23* can be in turn brought from the position shown with broken lines down into the plane of the ply of the turns WD21 and WD22, so that the value $\Delta y$ again corresponds to the predetermined value here and no inadmissible y-deviation is now present.

The quantity ΔF is also entered, this indicating the distance of the last turn WD23 from the flange FL1. When this distance ΔF is smaller than the diameter or, respectively, the width of the winding material, a rise-up can occur in the next turn; this, however, does not represent an error because the flange FL1 has been reached any way. In order to determine whether it is a matter of an admissible or an inadmissible ascent, the quantities Δy and ΔF are continuously determined and placed into relationship with one another, i.e. a check is respectively carried out as to whether an admissible or inadmissible modification is involved within the outer ply. The apex value of the light bands or height profile lines are thereby aimed at because a simple and especially exact positional identification is possible as a result thereof.

The position of the apexes of the turns are determined for at least two turns, for example WD22, WD23 of the new winding ply WL2 as viewed in radial direction with reference to the coil axis AX, and, given a deviation of these apex points from a rated value, a readjustment in the delivery of the winding material that reduces the deviation is implemented.

Due to a deviation in the size of the apex value Δy* of the last turn WD23* having the size of the apex value Δy of a preceding turn (for example, WD22) that derives given ascent of the last turn, a readjustment of the delivery in the sense of an increase in the lateral spacing from the penultimate turn WD22 is implemented and, thus, the ascent is undone.

When, as viewed in a parallel direction relative to the coil axis AX (x-direction), the spacing of the apexes of the turns is identified in the region of the meeting point AP of the winding material for at least respectively two turns WD22, WD23 of the new winding ply WL2, then an increase in the distance between the neighboring apexes derives given the occurrence of a gap between the penultimate (WD22) and the last turn (WD23). Based can this information, a readjustment of the delivery for the purpose of reducing the lateral spacing of the last turn WD23 relative to the penultimate trn WD22 is implemented and Δy is brought toward zero.

It is expedient to identify the position of the apexes of a plurality of neighboring turns, for example WD21, WD22 and WD23, and to form an average therefrom that is used as rated value Δy.

With D as cable diameter, a readjustment signal is generated with the central control means CU given a deviation the apex of the last turn WD23 in radial direction (y-direction) from the preceding turn WD22 beyond a tolerance value (preferably approximately D/20), said readjustment signal being advantageously proportional to the height difference of the apexes and to the cable diameter D in order to oppose the measured deviation as quickly as possible.

Given a deviation of the distance of the apex of the last turn WD23 from the apex of the preceding turn WD22 (i.e., in x-direction) from the rated value D of the cable diameter beyond a tolerance value (preferably approximately D/50), a readjustment signal is generated with the central control means CU that is advantageously proportional to the measured deviation from the rated value and to the diameter D in order to oppose the deviations as quickly as possible.

Figure 5:
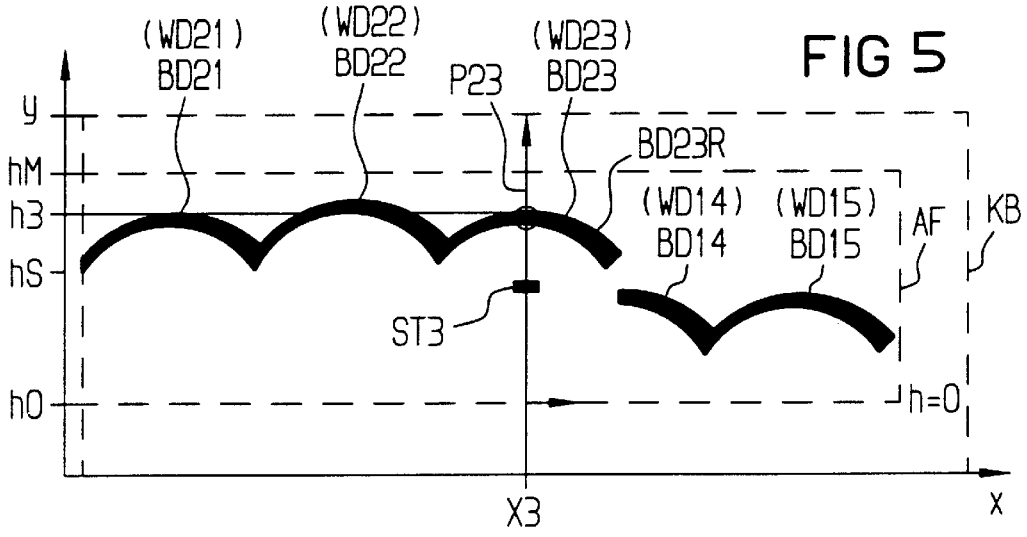
FIG. 5 shows a registered camera image evaluation window with a specific distribution of the cable plies.

Corresponding to FIGS. 2 and 3, FIG. 5 shows a camera image of a video camera directed onto a cable ply that is indicated by a broken-line bounding and is referenced KB. A smaller evaluation window AF that is indicated dot-dashed is expediently provided within this relatively large camera image KB of the video camera in order to reduce the image evaluation time. This evaluation window AF should cover at least two turns of the outer ply as well as, advantageously, at least one, preferably at least two turns of the inner ply, i.e. should preferably cover a total of four turns from two different winding plies. Advantageously, three or four turns per ply can also be acquired, as a result whereof the outlay in fact rises somewhat but the precision can also be improved. In order to recognize an approach to the flange as early as possible, at least two turns of the lower ply should be covered in the flange region.

Analogous to FIG. 2, FIG. 5 shows three image arcs BD21, BD22 and BD23 of three illuminated turns WD21 through WD23 of an outer ply. Over and above this, a further, bright image arc BD15 and a part of an image arc BD14 of the turns WD15 and WD14 of the ply lying therebelow can be seen. The ordinate of the illustrated diagram corresponds to the radial direction y with reference to the axis AX of the cable drum, whereas the x-direction proceeds parallel to the axis of the cable drum, i.e. in the direction wherein the individual turns are placed against one another. It is also assumed that a disturbance ST3 occurs in the region of the turn WD23, for example in the form of a marking that is applied on the cable cladding and that generates an additional light reflex that is registered by the video camera. The height h0 is assumed as the inner (smaller) radial spacing within the evaluation window AF seen in the y-direction, whereas the outer region of the excerpt covered by the evaluation window AF is referenced hM. The location at which the disturbance ST3 occurs is referenced hS, whereas the distance value (=apex value) corresponding to the maximum spacing of the light reflex of the turn WD23 is referenced h3.

Figure 6:
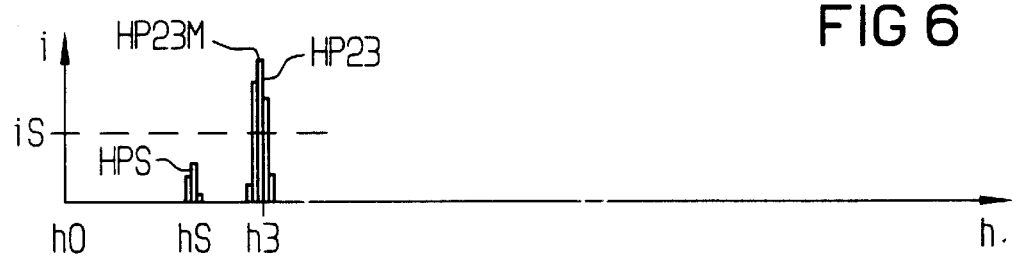
FIG. 6 shows the intensity curve belonging to FIG. 5.

The intensity curve i of the picture elements in y-direction, i.e. dependent on the height h from which the samples of the video camera are obtained, is shown in FIG. 6, namely for the position x3 corresponding to the line in the maximum range (apex range) P23 of the turn WD23. Intensity values HPS of the disturbance ST3 according to FIG. 5 derive at a specific distance hS from h0. The distribution of the intensity values HP23 occurs at a greater height or, respectively, range h3. This means that a column-by-column observation of the intensity values obtained from the x-scanning is implemented in the y-direction.

The lines of the video camera correspond to the y-direction according to FIG. 5; the columns correspond to the x-direction. The line-by-line scanning of the cable turns and the column-by-column interpretation of the intensity values according to FIG. 5 is simplified as a result thereof.

The two intensity distributions HPS and HP23 clearly differ in amplitude because the disturbance ST3 is not illuminated by the light band but by the ambient light and is thus weaker than the actual light reflexes BD21 through BD23 of FIG. 5 corresponding to the cable contour. By employing a threshold iS, it can be assumed that disturbances corresponding to HPS are blanked out, whereas the amplitude values corresponding to HP23 produced by the reflective cable surfaces are available for further interpretation.

Figure 7:
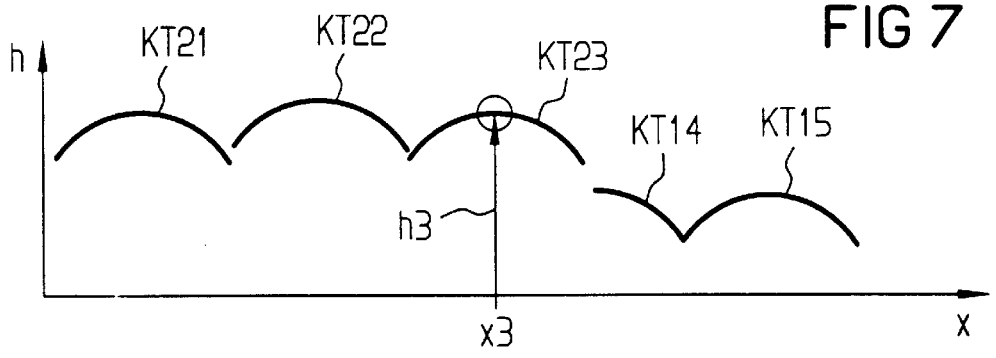
FIG. 7 shows the filtered contour curve deriving therefrom.

FIG. 7 shows the contour curve that has been cleaned (i.e., is without disturbances) directed only to the maximums, for example HP23M, of the respective picture elements of the light arc, whereby the height h here represents the ordinate, analogous to FIG. 5, and the abscissa represents the respective range values transverse relative to the longitudinal cable axis. The point P23 having the height h3 comprises the range x3 and, as described above, was obtained by the analysis of the column P23 in the apex of BD23. The FIGS. 5 through 7 thus show overall how disturbances can be suppressed and how a cleaned, more exact contour curve course (indicated by the thinner contour lines in FIG. 7) is obtained according to FIG. 7 from FIG. 5, this reproducing the outer contour lines of the acquired winding plies in a largely disturbance-free and, thus, clearer and unambiguous way.

The image or brightness arcs BD21 through BD23 in FIG. 5 are not uniformly distributed over the course of the respective arc but exhibit a more pronounced reflection behavior at specific locations, for example as a consequence of printing or the like as well, and thus yield brighter light reflexes. These are indicated by the broadened portions at the right-hand end of the image arcs. These actually undesired image constituents can be advantageously largely eliminated by the utilization of a high-pass filter, namely before further evaluation of the registered height profile lines is implemented. An approximately uniform image course is obtained as a result of this pre-filtering, i.e. the broadened portions in FIG. 5 disappear. As shown, i.e. the additional, disturbing parts such as, for example, BD23R are largely eliminated. As a result of this pre-filtering of the intensity values, particularly with a linear high-pass filter, thus, the edge transitions of the sought contour can be intensified and brightness fluctuations in the respectively registered image can be largely eliminated. In this way, for example, the intensity distribution HP23 in FIG. 6 receives clearly steeper edges and thus enables a more exact determination of the height values, for example h3.

The exact position of the respective maximum value (=apex value of the apex) of each of the contours KT21 through KT15 is now to be determined from the (cleaned) contour course of FIG. 7. All known methods for determining maximum values can be utilized for this purpose, such as, for example, differentiation, determination of difference value of successive measuring points, etc. This determination of the maximum value upon utilization of histograms shall be described below.

The relative height of the respective, successive contour points shown in FIG. 7 is entered into a list of the contour course, i.e. the continuous curve shown in FIG. 7 is, in reality, a succession of discrete, individual values in a height table, namely respectively correlated with the appertaining x-value.

Figure 8:
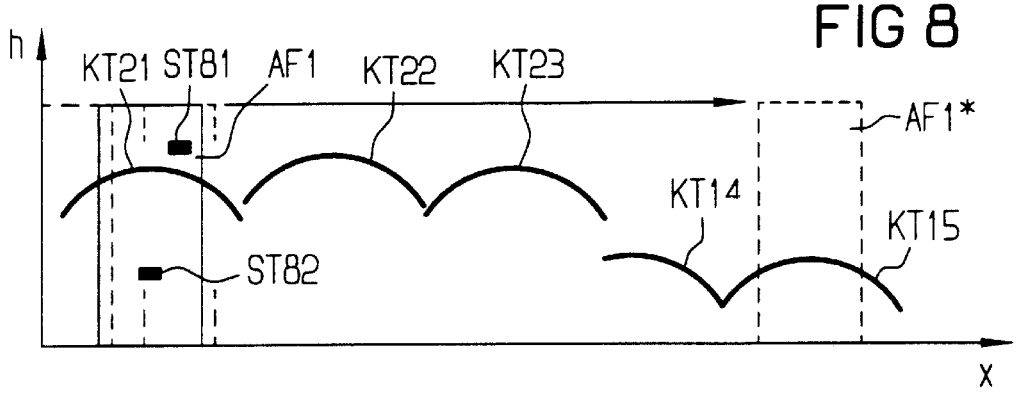
FIG. 8 shows the contour curve of FIG. 7 with an evaluation window.

After the clean contour course corresponding to FIG. 7 has been produced, a smaller evaluation window AF1 according to FIG. 8 is pushed over this contour course. FIG. 8 shows the same distribution as FIG. 7, i.e. the height h is entered on the ordinate and the distance x is entered on the abscissa. Potential disturbances that may still be present, i.e. those that were not capable of being completely eliminated by the measures according to FIG. 6, are schematically referenced ST81 and ST82. It is assumed that the scan window that is moved across the contour course continuously or in steps according to FIG. 8 lies on the contour KT21 of the turn WD21 at the moment. The evaluation window AF1 is narrower (preferably approximately 0.3–0.7 D, advantageously 0.5 D) than the cable diameter D in order to assure an evaluation in the contour course referred to the individual turn.

Figure 9:
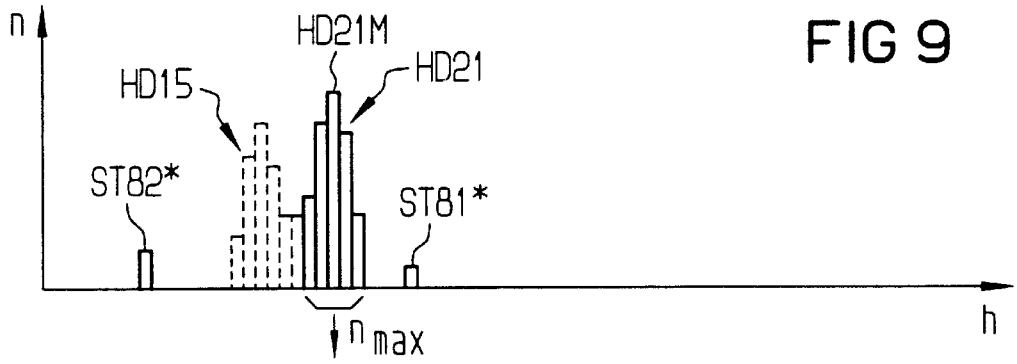
FIG. 9 shows a height histogram obtained from FIG. 8.

A height histogram that is shown in FIG. 9 is obtained in this way, whereby the ordinate reproduces the plurality n of points with identical height and the height h is entered on the abscissa. The illustrated histogram distribution, which is referenced HD21, derives at the turn WD21 from the step-by-step scanning of the contour course according to FIG. 8. The maximums of this distribution of the height values according to HD21M are written into a table according to FIG. 10. Three maximum values indicated by crosses are entered therein for illustration, whereof the middle one (as a result of averaging) is marked PD21M and corresponds to the position x1 of the maximum (apex of the turn WD21). This value x1 is entered into the diagram according to FIG. 10 or, respectively, written into a table, whereby the number of hits is shown on the ordinate, whereas the corresponding values x1 through x3 of corresponding maximums are entered on the x-axis, i.e. the apexes of neighboring turns.

In addition, the histogram HD15 is entered in FIG. 9 for the turn WD15 (scan window in the position AF1*), but this has a lower value of h because it is to be allocated to the ply WL1 lying therebelow. The apex value x5 of the turn WD15 is determined therefrom.

Figure 10:
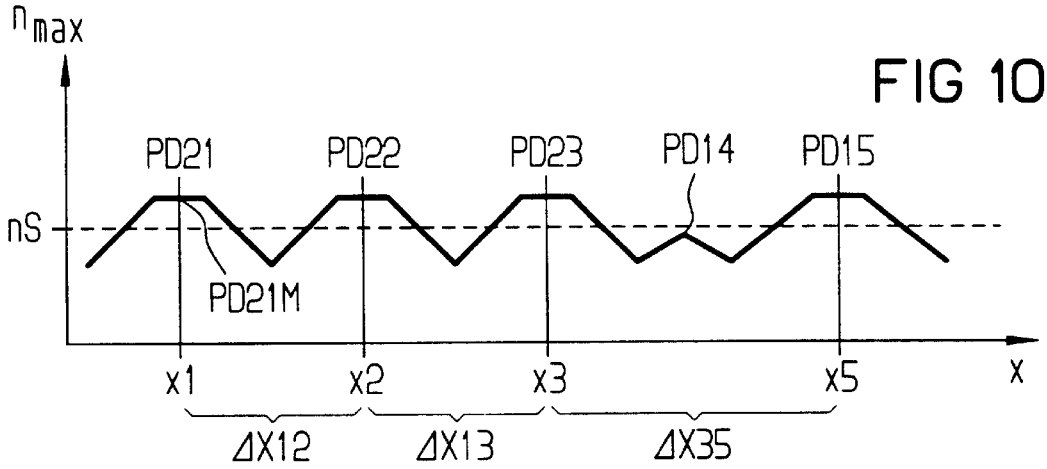
FIG. 10 shows the curve of maximum pixel values dependent on the position of the turns.

In a schematic presentation, thus, a curve of the sum of the hit values $n_{max}$ cleaned curve course, as shown in FIG. 10, derives, whereby the $n_{max}$ values from FIG. 9 are entered on the ordinate, whereas the abscissa reproduces the appertaining x-values. The maximum of the turn WD21 is referenced PD21M and corresponds to FIG. 8, which exhibits the same abscissa (x1). The same is true of the turns WD22 and WD23, whereby it can be seen that the distances Δx12 between x1 and x2 (=peak value of WD22) as well as Δx23 between x2 and x3 (=peak value of WD23) are of the same size, i.e. these turns, as should be the case, lie adjoined just opposed next to one another within a ply. Δx12 and Δx23, moreover, given a correct drumming, correspond to the cable diameter D that is likewise advantageously stored in the central computer and control unit CU and that can also be utilized for the interpretation.

The winding ply lying therebelow, which is indicated by the contour KT15 (=turn WD15), in fact supplies a similar value for $n_{max}$, as indicated by PD15, whereby, however, the position x5 clearly differs by 0x35 from the position x3, i.e. Δx35 is significantly different from the preceding values Δx12 and Δx23 between neighboring turns within the outer ply WL2. The lower value of PD14, as remainder of the contour KT14 of the turn WD14, is not relevant. The values of the lower ply WL1 can be clearly distinguished from those of the ply WL2 on the basis of the different height values h1 and h2 (see FIG. 13). Only the turns of the current winding ply, i.e. the apex values having approximately the same height ($h_2$), are utilized for the distance identification within the framework of checking for winding gaps.

In order to achieve a short evaluation time, the respectively new histogram according to FIG. 9 is determined from the most recently calculated histogram. To this end, the new height value of the pixel at the window end is entered into the histogram, and the height value of the pixel at the window start is removed from the histogram.

The storing of the amplitude values according to FIG. 9 ensues in a maximum list, i.e. the respective aggregate value $n_{max}$ and the appertaining height value h are stored together with the x-values x1 through x5 or, respectively, are written into a register.

During the shift of the evaluation window AF1, the positions of the individual turns (x1 through x4) can be separated from one another and exactly identified by the comparison of the maximum course to an adjustable threshold nS in FIG. 10. The influence of the disturbances ST81 and ST82 (FIG. 8) or, respectively, of the distributions ST82* and ST81* (FIG. 9) resulting therefrom are suppressed, for example, by a threshold, since their aggregate values $n_{max}$ are clearly lower than the $n_{max}$ values of the turns.

Figure 11:
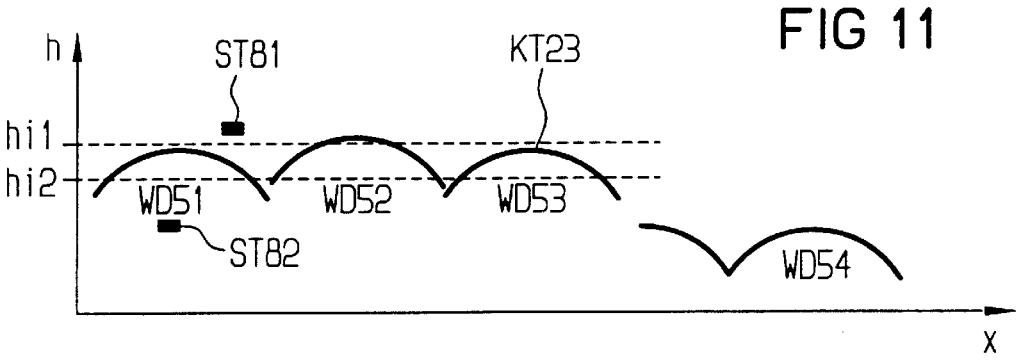
FIG. 11 shows the contour curve for different turns.

The clean contour course corresponding to FIG. 8 is shown again in FIG. 11, whereby the height h is entered on the ordinate and the distance x is entered on the abscissa.

Figure 12:
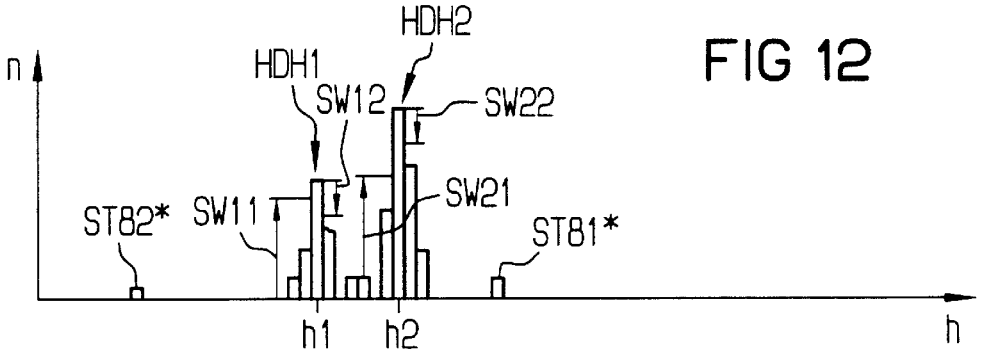
FIG. 12 shows a height histogram for different turn plies according to FIG. 11.

This contour course is scanned in x-direction, and the individual height values are entered into a histogram. The height histogram obtained in this way is reproduced in FIG. 12, where the height h is entered on the abscissa and the plurality n of picture elements of identical height is entered on the ordinate. In addition to the two distributions ST82* and ST81* for the disturbances ST82 and ST81 indicated in FIG. 11, two further distributions that are referenced HDH1 and HDH2 additional arise. In the interpretation of the individual distributions HDH1 and HDH2, thresholds are expediently introduced for the separation of the height distributions and for the maximum determination, these being referred to the local minimums and maximums of the distributions. The first of these thresholds SW11, which is shown at the distribution HDH1, proceeds from the value n=0 or from a minimum value for n. Only n—values that exceed this threshold SW1 (plus threshold) are allowed for further interpretation, as is the case, for example, for the rectangle of the distribution HDH1 indicated at the height h1. The same threshold (plus threshold)—proceeding here from a minimum value of n—is provided at the distribution HDH2 and is referenced SW21. A minus threshold is also provided, this being referenced SW12 at the distribution HDH1. The subsequent value n of the histogram must lie below this threshold SW12. The analogous case applies to the same minus threshold SW22 at the distribution HDH2, and only allows values for further interpretation wherein the following n-value is lower than the predetermined threshold distance SW22. By utilizing said thresholds, thus, an exact separation of the height distributions and an exact determination of the maximums is assured.

Figure 13:
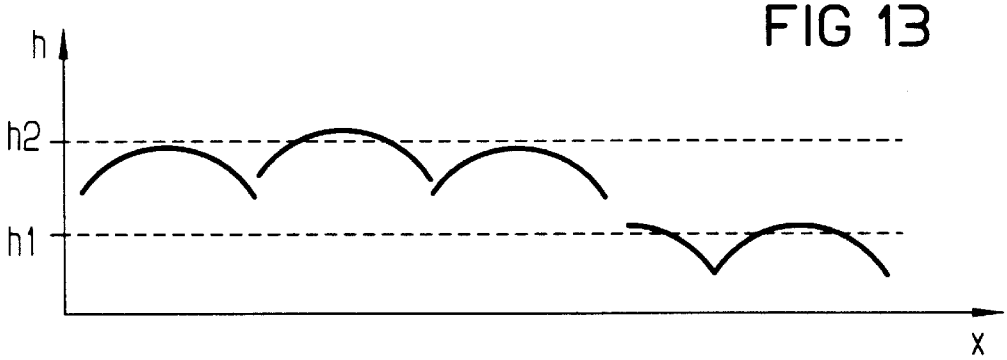
FIG. 13 shows the height levels found for different turn plies.

The height levels h1 (for the lower ply WL1) and h2 (for the outer ply WL2) found in this way are shown again in FIG. 13 dependent on the coordinate x and are essentially congruent with the average values of the apex points of the respective turns covered by the evaluation window.

Figure 14:
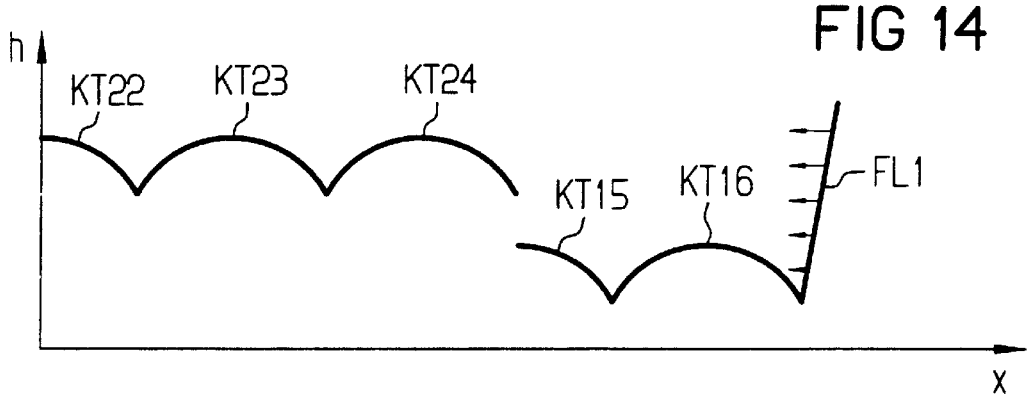
FIG. 14 shows a contour curve given approach to the flange.

FIG. 14 shows the contour course h dependent on x (i.e., after processing the steps according to FIG. 5 and 6) given approach of the outer ply to the flange FL1 of the wind-up drum. It is assumed that a further turn was applied in the outer ply compared to the preceding examples, the contour thereof being referenced KT24. The previous turn WD15 in the lower ply is only partially visible (KT15) and, instead, the neighboring turn abutting the flange FL1 and having the contour KT16 is covered. The flange FL1 appears as an oblique line, namely because of the projection under the observation angle. For enhancing the precision, the positions of all points of the contour curve are expediently transformed dependent on their height position. For calculating the shift in the x-direction, the equation $dx=-m\cdot h_x$ is employed, whereby m represents the slope of the flange contour in the image with reference to the coordinate system (h, x) and $h_x$ represents the height of the contour point at the position x.

Figure 15:
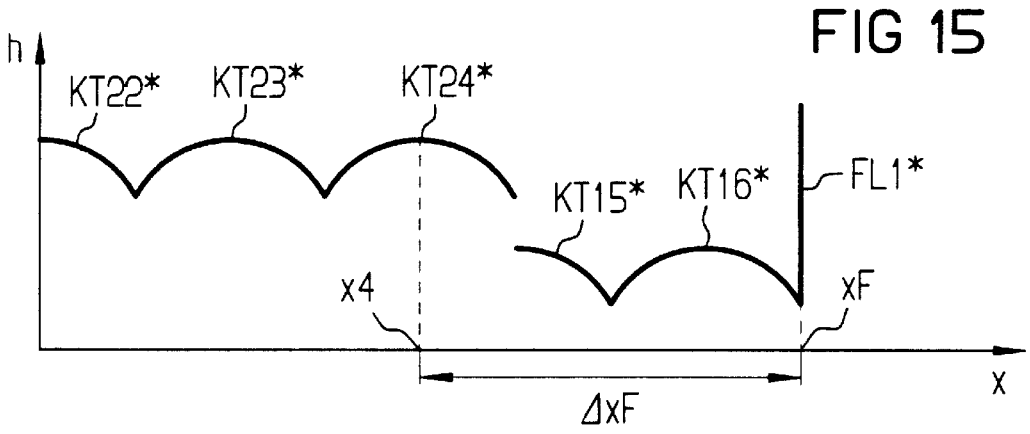
FIG. 15 shows a transformed contour curve derived from FIG. 14.

A new contour curve (transformed contour curve) is obtained after this transformation. This is shown in FIG. 15 and the flange is now shown as proceeding in h-direction and, for distinguishing it from FIG. 14, it is referenced FL1*. The contour curves that have likewise been transformed are referenced KT22* through KT16*. This transformed contour course is continuously generated because it is not known at what time the flange appears in the field of view.

Figure 16:
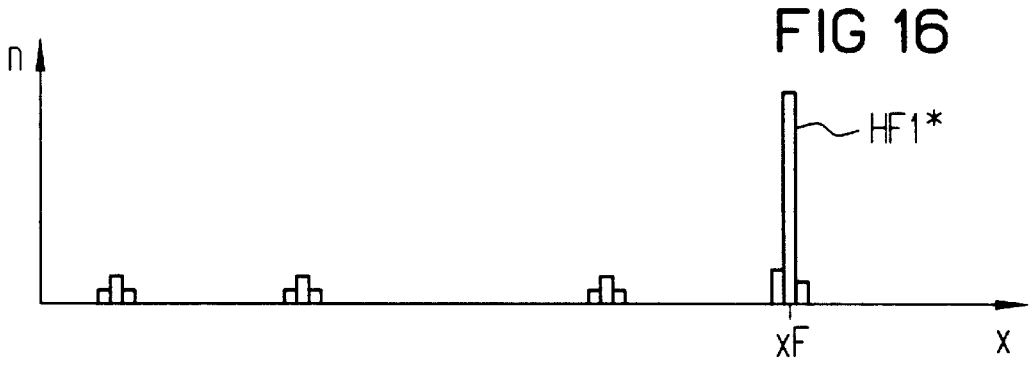
FIG. 16 shows a position histogram that is obtained from FIG. 15.

According to FIG. 16, the positions obtained in FIG. 15 are entered into a histogram, and one thus obtains a position histogram that represents the flange position xF, whereby this is obtained by the maximum of the histogram HF1* corresponding to the transformed line FL1* according to FIG. 15.

Given a gradually ensuing approach to the flange FL1, thus, the flange position xF is continuously identified anew and utilized for the further control of the drumming procedure.

As derives from FIG. 14 and FIG. 15, the distance ΔxF between x4 (apex of the last turn WD24 of WL2 having the contour KT24*) and xF of the line FL1* of the flange FL1 is even greater than the cable diameter D. Drumming can thus continue, namely until the distance ΔxF becomes smaller than half the cable diameter. In this case, the last turn already touches the flange FL1. When this point is reached, an "ascent" of the new turn occurs, but this is desired because a new ply is being started. It is thus not a matter of a faulty ascent, as was set forth in conjunction with FIG. 4, but of having reached the flange position as desired.

Subsequently, care must be exercised to see that the winding direction, that was always assumed to proceed from left to right in the above-described exemplary embodiments, now ensues from right to left, i.e. the traversing direction must be changed. This can be implemented according to the respective laying or, respectively, traversing method. Given employment of a laying arm or of a laying hand, this is no longer moved from left to right as hitherto but from right to left. When, instead of a laying arm, a winder traversing as a whole is employed, then the switching of the traversing direction must be implemented after the flange is reached.

Since the first turn of the newly started ply should expediently lie against the flange over its full length, it is expedient to arrest the traversing procedure itself for the time required in order to apply this first turn. This arresting of the traversing procedure can already ensue at the last turn of the last ply and can be continued beyond the reaching of the flange until the completion of the first turn. The traversing procedure is thus advantageously arrested in the region of the approach to the flange and for a certain time after this.

Figure 17:
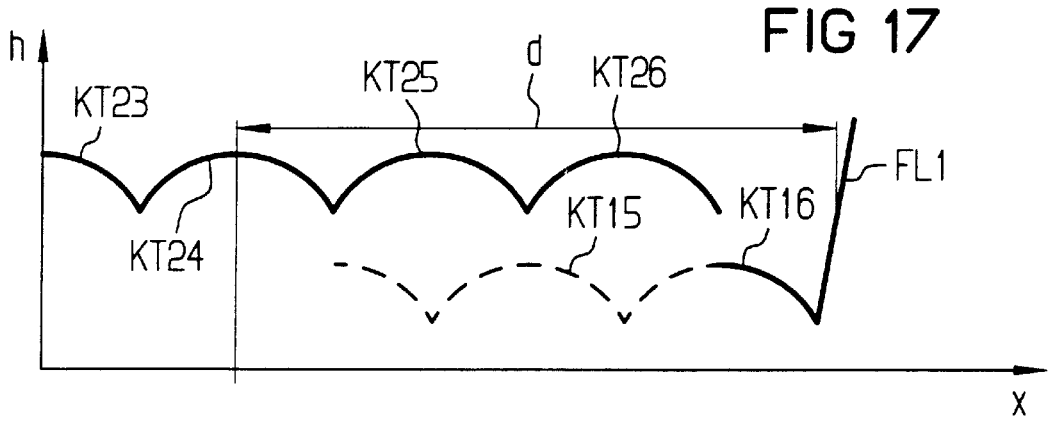
FIG. 17 shows a contour curve given further approach to the flange.

FIG. 17 shows the contour KT23 through KT26, whereby it is assumed that a further turn (KT26) was applied in the outer ply compared to FIG. 14. Such a great approach to the flange has thus been achieved that the gap is smaller than half the cable diameter. A new winding ply must thus be begun which, as already described, is initiated by arresting and subsequent reversal of the traversing procedure.

Figure 18:
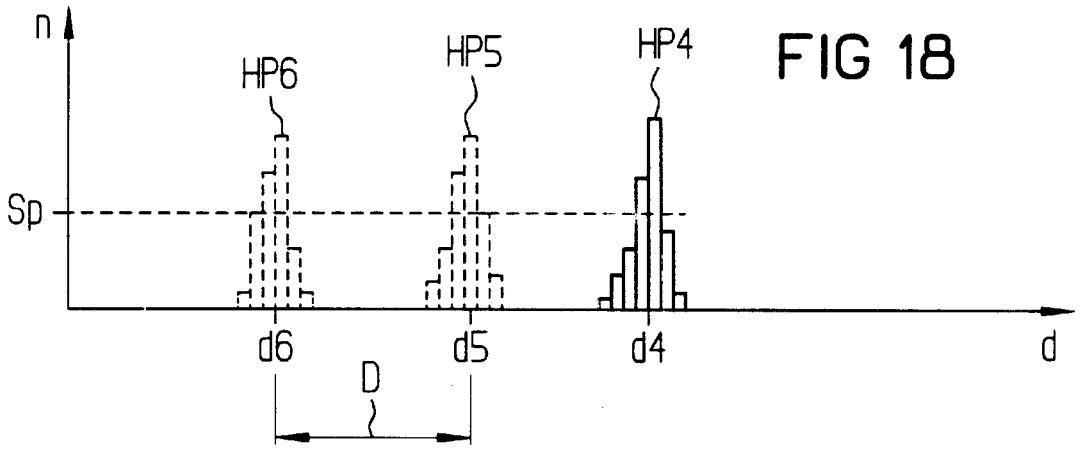
FIG. 18 shows a position histogram that is derived from FIG. 17.

Dependent on the position of the respective turn or, respectively, of the winding diameter, a specific plurality of images per video camera per revolution derives at the drum or coil (given a manufacturing speed of the cable that is assumed to be constant). When the winding diameter becomes greater, this plurality becomes greater. It must also be noted that a type of "unsteady point" is produced at the start of the winding procedure due to the run-in point of the cable upon passage through the flange (admission worm), this also appearing at the further plies—even though slightly flattened. This "unsteadiness point" effects a change of the x-coordinate that occurs in a short time, whereas x in the usual winding region outside this "unsteadiness point" changes only very slowly over time. The position of the cable or, respectively, of the respective turn continues to be determined analogous to FIGS. 8 through 16, whereby FIG. 18 shows the continuing approach to the flange. The respective distance d from the flange FL1 is entered on the abscissa, i.e. the distributions HP4 (=application of the turn WD24), HP5 (=application of the turn WD25) and HP6

(=application of the turn WD24) derive in the position histogram given the continuous approach, their maximums being respectively offset relative to one another by the cable diameter D. The distance values d thereby continuously decrease due to the continuing approach to the flange. By employing a corresponding threshold Sp, the determination of the respective maximum of the position histogram can dependably ensue, since disturbances are suppressed by the threshold.

The "unsteadiness point" marks the beginning of a new turn during which the next "unsteadiness point" that follows indicates the end of a turn. In order to then be able to determine the exact time span required for one revolution as exactly as possible independently of the respective diameter of the respectively applied ply, it lies at hand to count and retain the plurality of images registered by the video camera from one such "unsteadiness point" up to the following, next "unsteadiness point". Since the number of images per revolution is practically constant within a ply, a measured quantity is available that allows how long the application of a winding respectively lasts to be determined relatively exactly. This time span for the application of a winding can be applied particularly advantageously in the reversing of the traversing direction because the "ascent" is allowed here and the traversing procedure is merely arrested for a specific time. This time, which changes from ply to ply according to the circumference of the ply, is determined from the preceding winding time per ply and the traversing procedure is arrested for this length of time.

Given approach to the flange, it can be identified in advance from the known revolution time per turn when the respectively running turn no longer completely fits into the remaining gap, i.e. when a certain, allowed "ascent" occurs.

When the remaining distance is still relatively large, for example lies at 0.8 D, then the next-following turn will lie only slightly higher than the previous winding ply. A first turn is then formed that lies higher than the previous ply by only, for example, approximately 0.5 D. As a result of the depressions forming in this way, uniform windings would no longer be created in the flange region, and it can therefore be necessary to place a second turn onto the existing, first turn that proceeds correspondingly lower in order to prevent such depressions. The decision as to whether only one turn or two turns are applied as first turn given stationary traversing derives from the condition of the last winding ply at the moment of the remaining gap diminution below D.

The position histogram according to FIG. 18, which shows the distance of the respective turn from the flange, makes the pre-determination of the above-described ascent problem in the flange region in a simple way.

When, in FIG. 17, the flange is thus repeatedly recognized in succession in the evaluation window corresponding to AF1 in FIG. 8, then it is clear that an approach to the flange is ensuing and the distance of the cable being wound on from the flange at this point in time is entered into a position histogram according to FIG. 18. When the distance of the cable being wound on from the position of the flange FL1 becomes equal to the diameter of the cable, then contact occurs between the cable being wound on and the flange.

When the distance d from the flange, which can be easily identified from FIG. 18, becomes smaller than the cable diameter D, then a reversing of the laying procedure occurs, i.e. the next ply is placed onto the preceding one in the opposite direction.

At the same time, the values of h vary in a corresponding way, and the above-described process according to FIGS. 5 through 18 is run anew.

Figure 19:
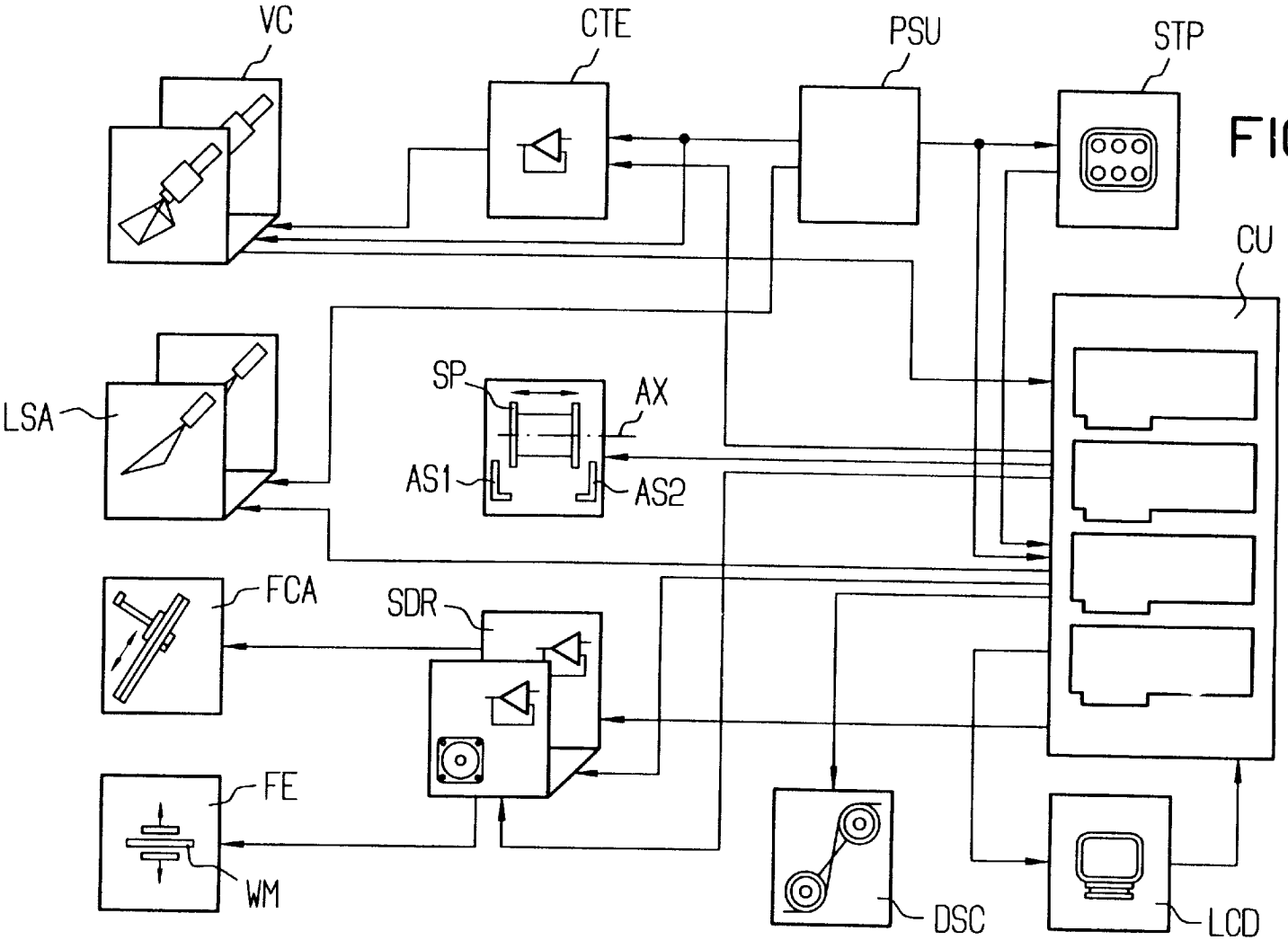
FIG. 19 is a schematic illustration showing the elements of a device for the implementation of the inventive method.

In a schematic illustration, FIG. 19 shows the basic structure of a cable laying device according to the invention. The cable drum SP can be displaced between two detents AS1 and AS2 for traversing, whereby it rotates simultaneously around the axis AX (the corresponding drive and adjustment means as well as the controller are not shown here). Commercially obtainable winding devices are utilized for this purpose in manufacture, these also being capable of being subsequently retrofitted in conformity with the invention. This type of laying has the advantageous that a winding-on point of the respective cable that is largely stationary in space can be utilized. The control of the traverse displacement of the cable drum SP is implemented proceeding from a central control means CU. The mechanical pre-stress of the cable (not shown here) that is being wound on is set with a dancer DSC whose tension can likewise be influenced proceeding from the central control means CU.

The illumination of the respective winding-on point ensues with the light of a laser LSA whose alignment is likewise controlled by the central control unit CU. Further, a central power supply PSU is provided, this serving the individual parts with the needed supply voltage, whereby the control of the various executive sequences can be implemented proceeding from a control panel STP.

One or more video camera VC are driven via the control electronics CTE, and they deliver their video signal to the central control unit CU wherein the interpretation according to FIGS. 5 through 18 is implemented. The control unit CU also controls the various servo drives, for example for the focusing of the laser/camera access FCA and for the fine adjustment of the guide means FE of the turn WM being respectively wound on in order to implement a uniform laying procedure or, respectively, the reversing from the coil wall when the side flange is reached. This fine displacement ensues, for example, with a guide fork or a sleeve ("cable hand") in which the respective cable is guided with its turn WM being wound on, whereby only small but extremely fast displacements can be implemented here. The respective conditions of the winding ply being wound on and/or the contour curves, corresponding to FIGS. 5 through 18, are presented on a display means LCD, for example a video picture screen.

Figure 20:
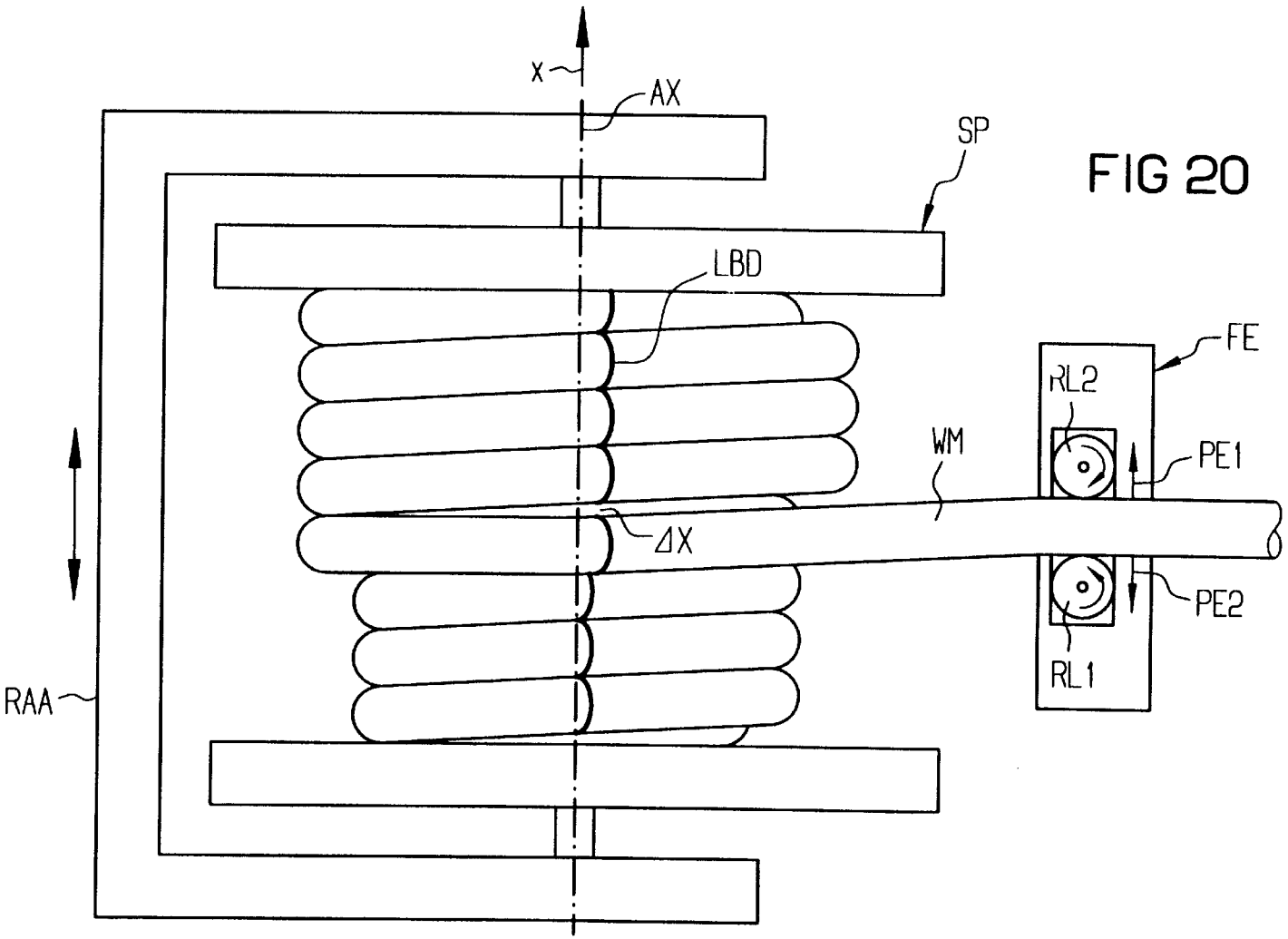
FIG. 20 is a plan view of the run-on of a cable onto the cable drum with a guide means.

In FIG. 20, the coil SP in the form of a cable drum is held at a frame RAA that is slowly, continuously displaced in conformity with the winding direction, namely parallel to the drum axis AX. The narrow, preferably chromatic, light band LBD can also be seen on the surface of the turns, whereby it is assumed in the present example that the entire width of the coil SP is illuminated by a corresponding, narrow light band. Given the turn just being wound on, an error has just occurred (=gap $\Delta X$ relative to the neighboring turn), as can be seen from the course of the light band LBD, which should trigger a corresponding correction event. Since the frame RAA with the entire cable drum SE is moved along the axis AX at a uniform speed, this is not suitable for undertaking part time and fast changes in the laying event. The guide means FE serves this purpose, this containing two rollers RL1 and RL2 in the present case that enclose the winding material WM between them finger-like and guide it exactly. As a result of a rapid movement according to the arrow PE1, the connection between the last turn and the turn to be applied at the moment can be restored to such an extent that the gap $\Delta X$ in turn disappears. From the occurrence of an error up to its correction by the readjustment of the winding material with the fine displacement, only a rotational angle range of less than 20°, preferably less than 5° should expediently have been traversed.

If an ascent should occur (see FIG. 4), then the guide means FE would be moved in the direction of the arrow PE2 and the ascent would be in turn eliminated as a result thereof. The guide means FE thus works very fast, so that only slight wrapping angles in the direction of the circumference of the winding are covered before the guide means FE intervenes in correcting fashion.

Figure 21:
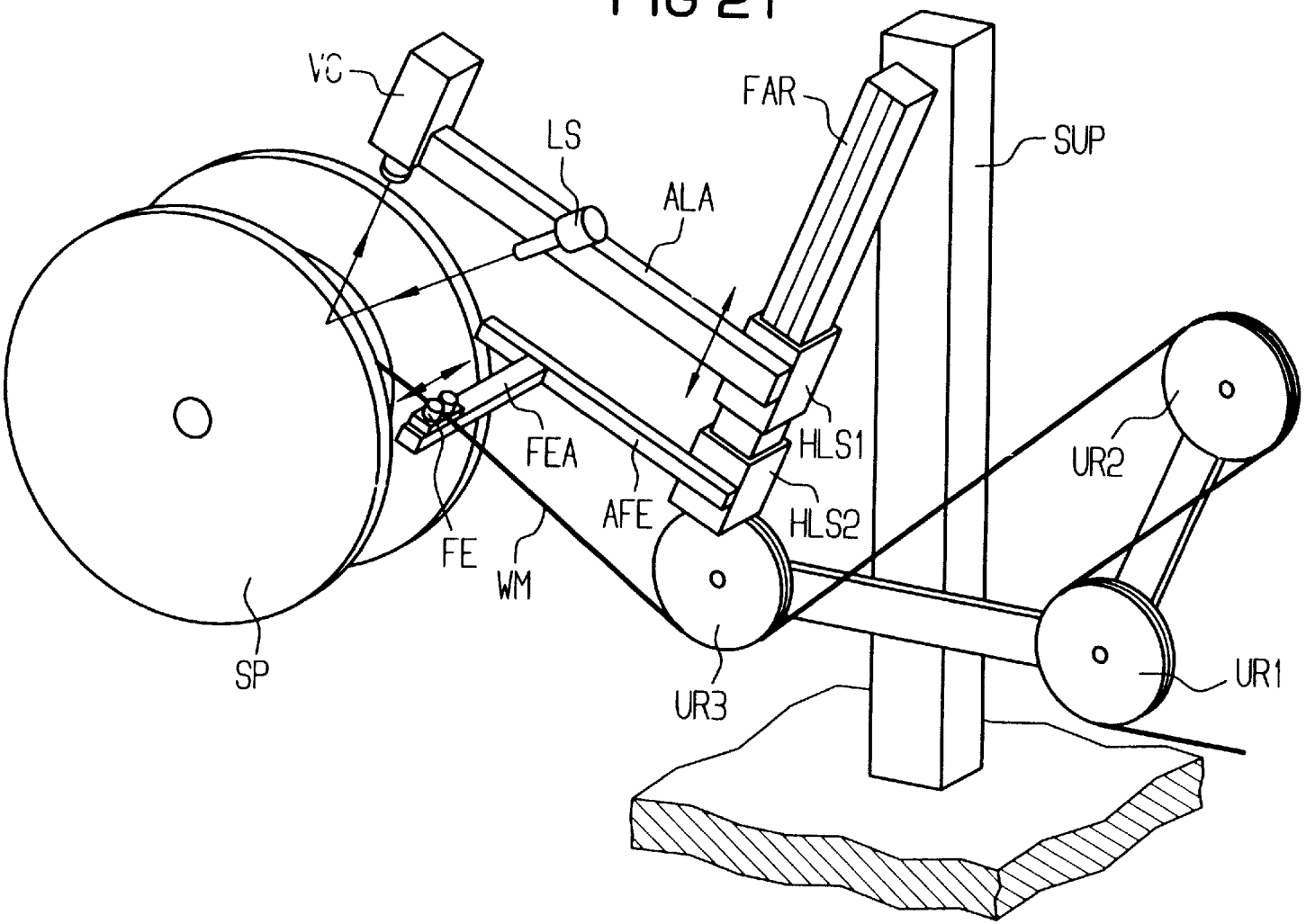
FIG. 21 is a perspective view showing the arrangement of the camera, the illumination means and the guide means in the cable delivery as viewed from the side.

In FIG. 21, the winding material WM runs over various deflection rollers UR1 through UR3 and ultimately proceeds via the guide means FE to the winding-up drum or, respectively, coil SP. The various deflection rollers UR1 through UR3 are secured to a support SUP that proceeds essentially in a vertical direction. Guide arm FAR is provided obliquely relative thereto, the guide means FE being held at its lower end via a boom AFE and a traverse arm FEA. This guide means FE effects the fine adjustment described in conjunction with FIG. 20, as indicated by the double arrow. The boom AFE is held at the guide arm FAR via a guide sleeve HLS2 and can thus be shifted upward along the axis thereof given increasing winding height, so that the guide correction can be implemented as fast and exactly as possible. Further, a boom ALA is provided at the guide arm FAR, this being arranged at a greater distance from the coil SP. This boom ALA is likewise held displaceable in longitudinal direction of the guide FAR by a guide sleeve HLS1 and carries the light source LS (laser light) that directs its beam onto the outer winding ply. Further, the video cameras VC are attached to the end of this boom ALA, their coverage area being directed onto the reflex zones of the light band (not visible here).

We claim:

1. A method for winding strand-shaped winding material onto a coil, wherein the winding material is continuously supplied, the position of the winding material is observed and registered by at least one video camera, and data about the winding obtained in this way are conducted to a computer unit that initiates a corresponding readjustment of the delivery of the winding material, the improvement comprising identifying, with reference to the coil axis as seen in radial direction, the position of the apexes of the turns for respectively at least two turns of the new winding ply; and for any given a deviation of these apexes from a rated value, implementing a readjustment in the delivery of the winding material that reduces the deviation.

2. A method according to claim 1, wherein, due to a deviation in the size of the apex value of the last turn from the size of the apex value of a preceding turn deriving given ascent of the last turn, a readjustment of the delivery for the purpose of increasing the lateral spacing from the penultimate turn is implemented.

3. A method according to claim 1, wherein, viewed in parallel direction relative to the coil axis, the distance of the apexes of the turn is determined in the region of a winding-on point of the winding material for respectively at least two turns of the new winding ply; and due to an increase in the distance between the neighboring apex values created by a given occurrence of a gap between the penultimate and the last turn, a readjustment of the delivery for the purpose of diminishing the lateral spacing of the last turn relative to the penultimate turn is implemented.

4. A method according to claim 1, wherein the condition of the position of the winding material in the region of the winding-on point is identified by the video camera serving the purpose of observation, where the winding material meets the winding ply lying therebelow.

5. A method according to claim 1, wherein, before the occurrence of an error until the correction thereof by the readjustment of the winding material, a winding range of less than 20° has been traversed.

6. A method according to claim 1, wherein the winding range is less than 5°.

7. A method according to claim 1, wherein the readjustment is implemented with a guide means engaging the winding material.

8. A method according to claim 1, wherein the winding material is illuminated in the region of the winding-on point by a light band that proceeds transverse relative to the winding direction.

9. A method according to claim 1, wherein any disturbances in the surface region of the turns are blanked out by filters and/or thresholds in the signal interpretation.

10. A method according to claim 1, wherein a cleaned contour curve corresponding to the surface course of the turns is acquired by a column-by-column processing of the examples acquired line-by-line.

11. A method according to claim 1, wherein the apex of at least one of the turns of the ply lying therebelow is defined.

12. A method according to claim 1, wherein the position of the apexes of a plurality of neighboring turns are identified and an average that is used as a rated value is formed therefrom.

13. A method according to claim 1, wherein, given a deviation of the apex of the last turn in a radial direction (y-direction) by more than a tolerance value, from the rated value, a readjustment signal is generated with the central control means, said readjustment signal opposing the measured deviation from the rated value.

14. A method according to claim 1, wherein, given a deviation of the lateral distance of the apex of the last turn from the apex of the preceding turn (x-direction) by more than a tolerance value, from the rated value D of the cable diameter, a readjustment signal that opposes the measured deviation from the rated value is generated with the central control means.

15. A method according to claim 1, wherein the observation is also implemented in the flange region.

16. A method according to claim 15, wherein, given approach to the flange, the distance of the last turn from the flange is continuously identified.

17. An apparatus for winding strand-shaped winding material onto a coil whereby the winding material is supplied via a guide means that modifies the winding ply of the winding material on the coil so that an optimum uniform wrapping occurs, said apparatus having a video camera for the observation of the winding ply that supplies the data about the position of the winding it identifies to a computer unit, which initiates a corresponding readjustment of the guide means, the improvement comprising the apparatus having a light source that generates a light band on at least parts of the last winding ply; and the video camera serving the purpose of observation being arranged so that it identifies the condition of the illuminated winding ply roughly in the region of the winding-on point where the winding material meets the winding ply lying therebelow.

18. An apparatus for winding strand-shaped winding material onto a coil whereby the winding material is supplied via a guide means that modifies a winding ply of the winding material on the coil so that a uniform wrapping occurs, said apparatus having a video camera for the observation of the winding ply that supplies data about a position of the winding material to a computer unit, which initiates a corresponding readjustment of the guide means, the improvement comprising the apparatus having a light source that generates a light band on at least parts of a last winding ply; and the video camera serving the purpose of observation being arranged so that the video camera identifies a condition of the illuminated winding ply roughly in the region of a winding-on point where the winding material meets the winding ply lying therebelow, and the computer unit being of the type that identifies, with reference to a coil axis as seen in a radial direction, the position of respective apexes of at least two turns of the last winding ply, and for any given deviation of these apexes from a rated value, the computer unit implements a readjustment in the delivery of the winding material that reduces the deviation.

* * * * *

UNITED STATES PATENT AND TRADEMARK OFFICE

CERTIFICATE OF CORRECTION

PATENT NO. : 6,443,385 B1
DATED : September 3, 2002
INVENTOR(S) : Grandauer et al.

It is certified that error appears in the above-identified patent and that said Letters Patent is hereby corrected as shown below:

Column 15,
Line 34, after "supplied," delete "the" and insert -- wherein a -- therefor;
Line 35, after the second "and" insert -- wherein --;
Line 36, after "the" insert -- position of the --, after "winding" insert -- material --, delete "are" and insert -- is -- therefor;
Line 39, after "to" delete "the" and insert -- a -- therefor, after "in" insert -- a --;
Line 40, after the first "of" delete "the" and insert -- respective -- therefor; after the second "of" delete "the turns for";
Line 41, delete "respectively"; after "of" delete "the" and insert -- a -- therefor;
Line 42, after "given" delete "a";
Line 45, after "claim 1," insert -- wherein the turns most recently added to the new winding ply are a last turn and a penultimate turn, wherein the position of an apex is defined by an apex value, and --;
Lines 47-48, after the second "of" delete "a preceding" and insert
-- the penultimate -- therefor; after the first "turn" delete "deriving given ascent of the last turn" and insert -- indicative of the last turn being at least partially wrapped about the penultimate turn --;
Line 49, after "increasing" delete "the";
Line 51, after "claim 1," insert -- wherein the turns most recently added to the new winding ply are a last turn and a penultimate turn, --;
Line 52, before "parallel" insert "a"; after "axis," delete "the" and insert -- a -- therefor; after "distance" delete "of" and insert -- between -- therefor;
Line 56, after "neighboring" delete "apex values" and insert -- apexes -- therefor;
Line 57, after "penultimate" insert -- turn --;
Line 59, after "diminishing" delete "the";
Lines 61-62, after "wherein" delete "the condition of";
Line 62, after the third "of" delete "the" and insert -- a -- therefor;
Line 63, after "point" insert -- where the winding material meets the winding ply lying therebelow --;
Lines 64-65, after "observation" delete ", where the winding material meets the winding ply lying therebelow";

UNITED STATES PATENT AND TRADEMARK OFFICE

CERTIFICATE OF CORRECTION

PATENT NO. : 6,443,385 B1
DATED : September 3, 2002
INVENTOR(S) : Grandauer et al.

It is certified that error appears in the above-identified patent and that said Letters Patent is hereby corrected as shown below:

Column 16,
Line 9, after "of" delete "the" and insert -- a -- therefor;
Line 10, after "to" delete "the" and insert -- a -- therefor;
Line 14, after "the" delete "surface region of the turns" and insert -- winding material -- therefor;
Line 14, after "out" delete "by filters and/or thresholds in the" and insert -- during -- therefor;
Line 16, after "to" delete "the" and insert -- a -- therefor;
Lines 17-18, after "of" delete "the examples" and insert -- images -- therefor;
Line 18, after "line-by-line" insert -- by the video camera --;
Line 20, after "lying" delete "therebelow is defined" and insert -- immediately below the new winding ply is identified -- therefor;
Line 26, after the second "of" delete "the" and insert -- a -- therefor;
Line 27, delete "(y-direction)" and after "value" delete ",";
Line 28, after "with" delete "the" and insert -- a -- therefor;
Line 29, after "signal" delete "opposing" and insert -- causing -- therefor;
Lines 29-30, after "the" delete "mea-sured";
Line 30, after "value" insert -- to be reduced --;
Line 31, after "claim 1," insert -- wherein the turns most recently added to the new winding are a last turn and a penultimate turn, wherein the rated value is based upon a diameter of the winding material, and --;
Line 32, after the first "of" delete "the" and insert -- a -- therefor;
Line 33, after the second "the" delete "preceding" and insert -- penultimate -- therefor; after "turn" delete "(x-direction)" and insert -- in a direction parallel to the core axis -- therefor;
Line 34, after "value" delete ",";
Lines 34-35, after "value" delete "D of the cable diameter";
Line 35, after "signal" delete "that opposes" and insert -- causing a reduction in- -- therefor; after "the" delete "measured";
Line 36, after "with" delete "the" and insert -- a -- therefor;
Line 39, after "implemented" delete "in the" and insert -- proximate -- therefor; after "flange" delete "region" and insert -- of the coil -- therefor;
Line 41, after "flange," delete "the" and insert -- a -- therefor; after "of" delete "the" and insert -- a -- therefor;
Line 43, after "modifies" delete "the" and insert -- a -- therefor;
Line 44, after "that" delete "an optimum" and insert -- a -- therefor;
Line 48, after "supplies" delete "the";

UNITED STATES PATENT AND TRADEMARK OFFICE

CERTIFICATE OF CORRECTION

PATENT NO. : 6,443,385 B1
DATED : September 3, 2002
INVENTOR(S) : Grandauer et al.

It is certified that error appears in the above-identified patent and that said Letters Patent is hereby corrected as shown below:

Column 16 (cont'd),
Line 49, after "about" delete "the" and insert -- a -- therefor; after "winding" delete "it identifies" and insert -- material -- therefor;
Line 53, after "of" delete "the" and insert -- a -- therefor;
Line 54, after "that" delete "it" and insert -- the video camera -- therefor;
Line 55, after "fies" delete "the" and insert -- a -- therefor;
Line 56, after "of" delete "the" and insert -- a -- therefor;
Line 57, after "therebelow" insert -- ,wherein the video camera defines a beam axis that is offset in a circumferential direction by a first angle relative to a radial direction of the coil at the winding-on point, wherein the light source has a beam axis that is offset in an opposed circumferential direction by a second angle relative to the radial direction of the coil at the winding-on point, and wherein the first and second angles form an aggregate angle having a value within a range from about 10° to about 60° --

Signed and Sealed this

Twenty-sixth Day of August, 2003

JAMES E. ROGAN
*Director of the United States Patent and Trademark Office*